US006357525B1

(12) United States Patent
Langseth et al.

(10) Patent No.: US 6,357,525 B1
(45) Date of Patent: Mar. 19, 2002

(54) METHOD AND APPARATUS FOR TESTING A WELL

(75) Inventors: Bjorn Langseth, Missouri City; Christopher W. Spiers, Sugar Land; Mark Vella, Malta; Dinesh R. Patel, Sugar Land, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/552,806

(22) Filed: Apr. 20, 2000

Related U.S. Application Data

(63) Continuation-in-part of application No. 09/512,438, filed on Feb. 25, 2000

(60) Provisional application No. 60/130,589, filed on Apr. 22, 1999.

(51) Int. Cl.[7] ..... E21B 49/08

(52) U.S. Cl. ..... 166/264; 166/266; 166/147

(58) Field of Search ..... 166/250.01, 250.02, 166/250.07, 264, 266, 269, 66.6, 66.7, 147, 167

(56) References Cited

U.S. PATENT DOCUMENTS

| | | | |
|---|---|---|---|
| 3,111,169 | A | 11/1963 | Hyde |
| 3,195,633 | A | 7/1965 | Jacob |
| 3,294,170 | A | 12/1966 | Warren et al. |

(List continued on next page.)

FOREIGN PATENT DOCUMENTS

| | | |
|---|---|---|
| EP | 0 022 357 | 1/1981 |
| EP | 0 176 410 | 4/1986 |
| EP | 0 481 866 A2 | 4/1992 |
| EP | 1 041 244 | 10/2000 |
| WO | WO 98/13579 | 4/1998 |
| WO | WO 98/36155 | 8/1998 |
| WO | WO 98/37307 | 8/1998 |
| WO | WO 98/48146 | 10/1998 |
| WO | WO 99/19602 | 4/1999 |
| WO | WO 99/24689 | 5/1999 |
| WO | WO 01/49973 | 7/2001 |

OTHER PUBLICATIONS

Aly, Ahmed; Characterizing Multi–Layer Reservoirs Using a Fast Computational Simulator and a New Environmentally Sensitive Pre–Production Well Test; Dissertation, Texas A&M University; Aug. 1995; p. 1–321.

Aly, Ahmed; Characterizing Multi–Layered Reservoirs Using a New, Simple, Inexpensive and Environmentally Sensitive Pre–Production Well Test; SPE 70$^{th}$ Annual Technical Conference and Exhibition, Dallas, Texas, Oct. 22–25, 1995.

Aly, Ahmed, and Lee, W. John; Characterizing Multi–Layered Reservoirs Using a New Simple, Inexpensive and Environmentally Sensitive Pre–Production Well Test; SPE Annual Technical Conference and Exhibition, Denver, Colorado; Oct. 5–9, 1996.

(List continued on next page.)

*Primary Examiner*—Frank S. Tsay
(74) *Attorney, Agent, or Firm*—Trop Pruner & Hu P.C.

(57) ABSTRACT

A test system and method for testing a well having a first and second zone includes a chamber and an isolation device moveable in the chamber. The isolation device separates a first and a second portion of the chamber. The chamber is adapted to receive fluid in the second chamber portion from the first zone. The isolation device is adapted to be moved in the chamber in a first direction by the first zone fluid. The first chamber portion can be charged with fluid pressure to move the isolation device in a second direction to pump the first zone fluid inside the second chamber portion into the second zone.

20 Claims, 13 Drawing Sheets

U.S. PATENT DOCUMENTS

| | | | | |
|---|---|---|---|---|
| 3,305,014 | A | | 2/1967 | Brieger |
| 3,611,799 | A | | 10/1971 | Davis |
| 4,009,756 | A | | 3/1977 | Zehren |
| 4,210,018 | A | * | 7/1980 | Brieger ..... 73/155 |
| 4,296,810 | A | | 10/1981 | Price |
| 4,434,854 | A | | 3/1984 | Vann et al. |
| 4,509,604 | A | | 4/1985 | Upchurch |
| 4,535,843 | A | | 8/1985 | Jageler |
| 4,560,000 | A | | 12/1985 | Upchurch |
| 4,583,595 | A | | 4/1986 | Czernichow et al. |
| 4,597,439 | A | | 7/1986 | Meek |
| 4,633,945 | A | | 1/1987 | Upchurch |
| 4,742,459 | A | | 5/1988 | Lasseter |
| 4,745,802 | A | | 5/1988 | Purfurst |
| 4,766,957 | A | | 8/1988 | McIntyre |
| 4,770,243 | A | | 9/1988 | Fouillout et al. |
| 4,803,873 | A | | 2/1989 | Ehlig-Economides |
| 4,856,585 | A | | 8/1989 | White et al. |
| 4,860,581 | A | | 8/1989 | Zimmerman et al. |
| 5,006,046 | A | | 4/1991 | Buckman et al. |
| 5,065,619 | A | | 11/1991 | Myska |
| 5,170,844 | A | | 12/1992 | George et al. |
| 5,337,821 | A | | 8/1994 | Peterson |
| 5,348,420 | A | | 9/1994 | Bernhardt |
| 5,353,870 | A | | 10/1994 | Harris |
| 5,361,839 | A | | 11/1994 | Griffith et al. |
| 5,425,416 | A | | 6/1995 | Hammeke et al. |
| 5,540,280 | A | | 7/1996 | Schultz et al. |
| 5,555,945 | A | | 9/1996 | Schultz et al. |
| 5,655,605 | A | | 8/1997 | Matthews |
| 5,762,149 | A | | 6/1998 | Donovan et al. |
| 5,799,733 | A | | 9/1998 | Ringgenberg et al. |
| 5,803,186 | A | | 9/1998 | Berger et al. |
| 5,826,662 | A | | 10/1998 | Beck et al. |
| 5,887,652 | A | | 3/1999 | Beck et al. |

OTHER PUBLICATIONS

SHORE–TEC AS; Downhole Production Testing; Downhole Production Testing Development Project; Jun. 17, 1997.

Woie, Rune; Downhole Pump for Well TestingDownhole Pump for Well Testing; WTN: New Formation Evaluation Tools Workshop; Apr. 27–29, 1998.

Antropov, A.D. and Galiev, N.S. and Elizarov, A.V. and Maksimov, V.P.; Results of Testing the Downhole Unit for Water Injection Between Formations on the Trekhozernoe Oilfield; Gipro Tyumen Nefte Gaz, Oil Producing Department "Shaimneft".

* cited by examiner

METHOD AND APPARATUS FOR TESTING A WELL

This application is a continuation-in-part of U.S. Non-Provisional Application Ser. No. 09/512,438 filed by Langseth, Spiers, Patel, and Vella on Feb. 25, 2000 and entitled "Method and Apparatus for Testing a Well", which claims priority under 35 U.S.C. §119(e) to U.S. Provisional Application Ser. No. 60/130,589, entitled "Method and Apparatus for Testing a Well," filed Apr. 22, 1999.

BACKGROUND

The invention relates to methods and apparatus for testing wells.

After a wellbore has been drilled, testing (e.g., drillstem testing or production testing) may be performed to determine the nature and characteristics of one or more zones of a formation before the well is completed. Characteristics that are tested for include the permeability of a formation, volume and pressure of a reservoir in the formation, fluid content of the reservoir, and other characteristics. To obtain the desired data, fluid samples may be taken as well as measurements made with downhole sensors and other instruments.

One type of testing that may be performed is a closed-chamber drillstem test. In a closed-chamber test, the well is closed in at the surface when producing from the formation under test. Instruments may be positioned downhole and at the surface to make measurements. One advantage offered by closed-chamber testing is that hydrocarbons and other well fluids are not produced to the surface during the test. This alleviates some of the environmental concerns associated with having to burn off or otherwise dispose of hydrocarbons that are produced to the surface. However, conventional closed-chamber testing is limited in its accuracy and completeness due to limited flow of fluids from the formation under test. The amount of fluids that can be produced from the zone under test may be limited by the volume of the closed chamber.

A further issue associated with testing a well is communication of test results to the surface. Some type of mechanism is needed to communicate collected test data to well surface equipment. One possible communications mechanism is to run an electrical cable down the wellbore to the sensors. This, however, may add to the complexity and reduce the reliability of the test string.

A need thus exists for an improved method and apparatus for testing wells.

SUMMARY

In general, according to one embodiment, a test system for testing a well having a first zone and a second zone includes a chamber and an isolation device moveable in the chamber. The isolation device separates a first and a second portion of the chamber. The chamber is adapted to receive fluid in the second chamber portion from the first zone, the isolation device being adapted to be moved in the chamber in a first direction by the first zone fluid. The first chamber portion is chargeable with fluid pressure to move the isolation device in a second direction to pump the first zone fluid inside the second chamber portion into the second zone.

In general, in accordance with another embodiment, a test system for testing a formation in a well includes a flow conduit having a first general flow area adapted to receive fluid from the formation and a closed chamber including a tubing having a second general flow area that is greater than the first general flow area. The closed chamber is adapted to receive formation fluid from the flow conduit.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "below" and "above"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Further, the relative positions of the referenced components may be reversed.

Figure 1:
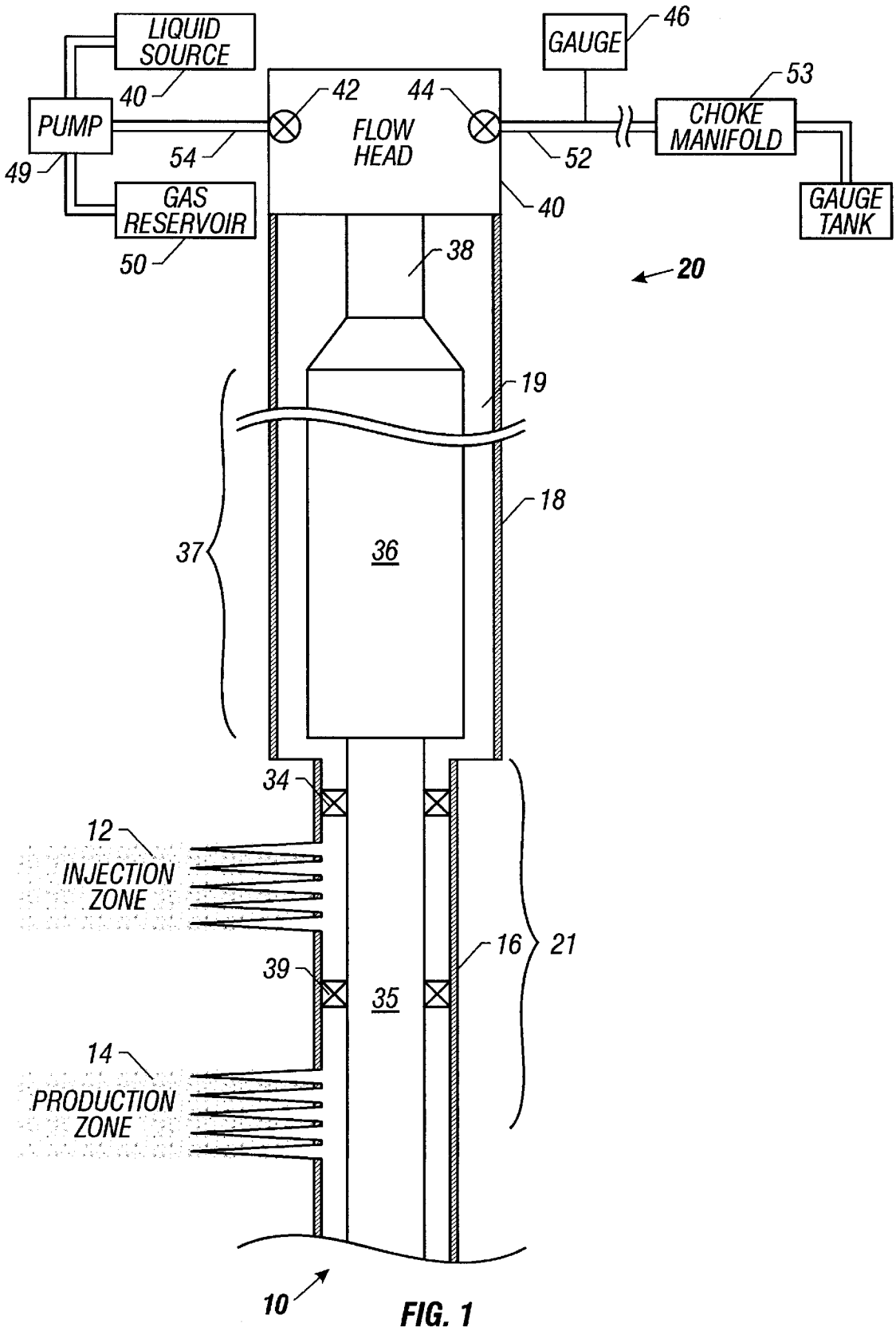
FIG. 1 illustrates an embodiment of a test string for testing a well.

Referring to FIG. 1, a test string 20 according to one embodiment is positioned in a wellbore 10. The wellbore 10 may be part of a subsea well or a land well. The wellbore 10 may include a production zone 14 and an injection or storage zone 12. Additional production zones and/or storage zones may also be present. An upper section of the wellbore 10 may be lined with casing 18, while a lower section may be lined with a liner 16. In the upper section of the wellbore 10, an enlarged tubing 36 having an increased diameter (compared to the diameter of the section of the wellbore below the tubing 36) forms part of a relatively large volume chamber 37 into which well fluids may flow during closed-chamber testing. The chamber 37 may also include a reduced diameter upper tubing 38 coupled above the enlarged tubing 36 and extending to surface equipment 40. Alternatively, the enlarged tubing 36 may extend all the way to the well surface. As used here, "well surface" may refer to the surface of a land well or to the mud line of a subsea well. Thus, in accordance with one embodiment, the test string 20 includes a flow conduit (including a pipe 35) having an inner flow area that is smaller than the flow area provided by the tubing 36.

Initially, the chamber 37 including the enlarged tubing 36 and the upper tubing 38 may be filled with air (or some other gas, such as nitrogen) to provide an atmospheric chamber. Alternatively, a relatively light-weight liquid may be initially stored in the chamber 37 that can be moved by the first zone fluid. The cushion of air (or some other gas) may be pushed upwardly when fluid is produced from the production zone 14 into the chamber 37. At the surface, a valve 44 may be opened to allow the gas to pass through a conduit 52 in which a gauge, flow meter, and/or other measuring device 46 may be attached to monitor the pressure increase in atmospheric chamber 37, from which flow rate into the atmospheric chamber 37 can be estimated. The surface equipment 40 may also include a second valve 42 connected to a conduit 54 that is adapted to receive either a liquid from a liquid source 48 or a gas from a gas reservoir 50. A pump 49 is adapted to pump either the liquid from the liquid source 37 or gas from the gas reservoir into the tubing 38.

A lower test string section 21 including the pipe 35 is connected below the tubing 36. Upper and lower packers 34 and 39 seal respective annular portions outside the pipe 35 to isolate the production and storage zones 14 and 12 as well as the upper wellbore section (including annulus region 19) above the upper packer 34. The upper and lower packers 32 and 34 may be compression set, hydraulic set, or other packers. As illustrated, the flow area available in the lower test string section 21 may be smaller than the flow area of the tubing 36.

In other embodiments, other arrangements of the test string 20 may be possible, with components added, omitted, or substituted. For example, the tubing 36 may have substantially the same diameter as the pipe 35 in the lower test string section 21.

According to one embodiment of the invention, improved test data may be obtained by enlarging the total volume of the chamber 37. This may be accomplished by increasing the size of the tubing 36. For example, a 7-inch tubing 36 may be positioned in a 9⅝-inch casing 18. As compared to 3½-inch tubing used in some conventional closed-chamber test systems, an increase in volume of fluids that may be flowed from the production zone 14 may be achieved (e.g., five-fold increase in production volume as compared to conventional systems). The depth of investigation into the formation in the production zone 14 is proportional to the square root of the production volume. Thus, for example, a five-fold increase in production volume may double the depth of investigation into the formation in the production zone 14 so that deeper penetration into the formation may be achieved for testing.

Another feature offered by some embodiments of the invention is the ability to flow into the chamber 37 multiple times; that is, multiple test flow cycles may be performed. A test flow cycle may be defined as producing fluid from the production zone 14 into the chamber 37 until the production fluid has filled the chamber 37 to a predetermined level, after which the fluid in the chamber 37 is communicated to the storage formation zone 12. Thus, after each flow cycle when production fluid has filled the chamber 37 to a predetermined level, downhole valves may be actuated (some opened and others closed) to isolate the production zone 14 and to enable fluid communication between the chamber 37 and the storage zone 12. After production fluid has been pumped from the chamber 37 into the storage zone 12, the chamber 37 may be filled again with a cushion of gas. After this, another flow cycle can be performed in which production fluid from the production zone 14 is directed into the chamber 37. A benefit is that clean-up of the formation in the production zone 14 can also be improved as a result of the multiple flow cycles. Before collecting samples of fluids from the production zone 14, it is desirable to remove such contaminants as water, sand, cement particles, or other types of contaminants by pumping the collected fluid into the storage zone 12.

Figure 2:
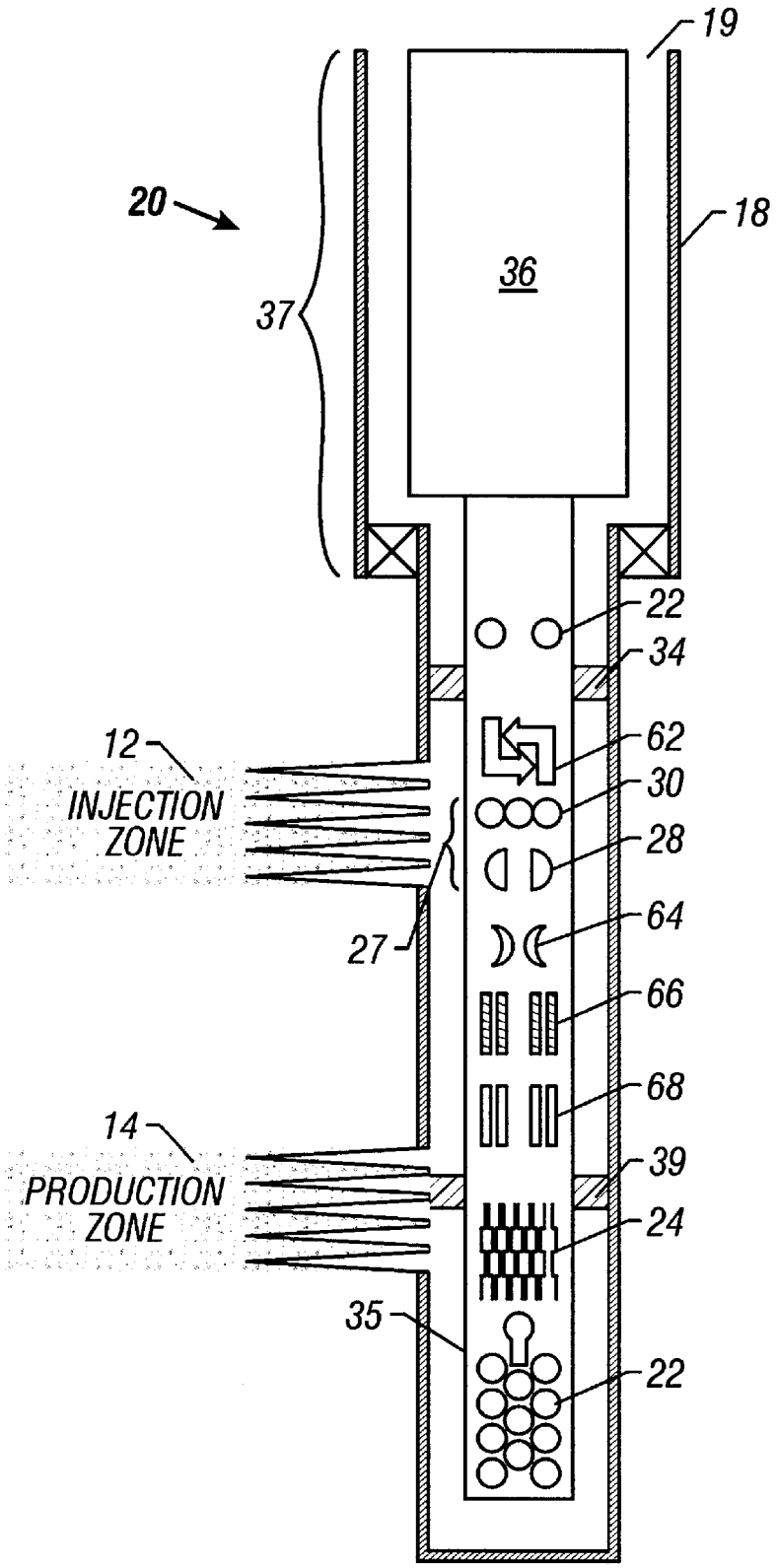
FIGS. 2–4 illustrate different embodiments of the test string of FIG. 1.

Referring further to FIG. 2, the lower test string section 21 is illustrated in greater detail. One or more perforating guns 22 may be attached at the lower end of the test string section 21 to create perforations in the production zone 14 and in the storage zone 12. Alternatively, a separate run of a perforating string may be used to create the perforations in the production and storage zones. A slotted pipe 24 is positioned in the test string section 21 underneath the lower packer 36 to prevent larger debris from being produced into the test string 20. The slotted pipe 24 may be part of the main pipe 35 or may be a separate piece connected to the pipe 35. Alternatively, a prepacked or other screen may be used to filter out the debris. Removing debris reduces the chance of larger debris in the test string 20 plugging up the storage zone 12.

The lower test string section 21 may also include a downhole sampler device 68 having samplers to collect fluid samples from the production zone 14. Although shown in FIG. 2 as positioned below the packer 34, further embodiments may have the sampler device 68 positioned above the packer 34. The sampler device 68 may include monophasic downhole samplers that are run in a full-bore carrier, although other types of samplers may be used in further embodiments. The sampler device 68 may be activated and controlled using low-level pressure pulses in the tubing 36 or in the annulus region 19 between the tubing 36 and the casing 18. Downhole control devices that may be activated with low-level pressure pulses are described in U.S. Pat. Nos. 4,896,722; 4,915,168 and Reexamination Certificate B1 4,915,168; 4,856,595; 4,796,699; 4,971,160; and 5,050,675, are hereby incorporated by reference. Low-level pressure pulses from the annulus 19 may be communicated through a conduit that may be ported through the upper packer 34 to the sampler device 68.

Other forms of activation mechanisms may be used. For example, fluid pressure control lines and electrical control lines may be run down the test string 20 to the electrical devices to be controlled. Alternatively, a device such as the one described in connection with FIGS. 6–10 may be used.

The lower test string section 21 may also include pressure and temperature sensors and recorders 66 that are used to collect pressure and temperature data during flow periods and shut-ins of the production zone 14. Recorders 66 may include electronic storage elements, such as integrated circuit memory devices. The sensors and recorders 66 may also be coupled to a downhole power source (e.g., a battery). An adjustable choke device 64 may also be included in the test string 20 to control the flow rate of production fluids from the production zone 14. The adjustable choke device 64 can be adapted to control flow of production fluids from the production zone 14 at a stable rate. The flow rate through the adjustable choke device 64 may be controlled such that the flow of production fluid into the chamber 37 is substantially constant. By maintaining stable flow rate and pressure, more reliable test measurements can be made.

Alternatively, the well may be controlled at a fixed bottom hole pressure. Either technique may be used to avoid flowing production fluid below the bubble point. The adjustable choke device 64 may include variations of valves selectively positionable at open, closed, and intermediate positions. Such valves may be associated with sleeve valve assemblies having indexing mechanisms to provide the intermediate positions between open and closed. Alternatively, the valves may include disk valves, such as ones described in co-pending U.S. patent application Ser. No. 09/243,401, filed Feb. 1, 1999, entitled "Valves for Use in Wells," by David L. Malone, which is hereby incorporated by reference.

The adjustable choke device 64 may be controllable from the surface. Alternatively, the adjustable choke device 64 may be an intelligent device capable of adjusting itself based on sensed conditions such as flow rate, pressure, and temperature. An intelligent adjustable choke device may include electronic circuitry (e.g., a microcontroller, microprocessor, or other control device) capable of making control decisions to control the choke device. The adjustable choke device 64 can also be used to measure the flow rate in the test system 20.

A flow control valve 27 may also be included in the lower test string section 21 to control flow from the production zone 14 and into the storage zone 12. The flow control valve 27 may be a dual valve assembly that includes a ball valve 28 and a sleeve valve 30. Alternatively, the valves may be separate components. The valve assembly may also include flapper valves or other types of valves. The flow control valve 27 may be controlled using low-level pressure pulses or other activation mechanisms, such as those noted above. The ball valve 28 acts as a downhole shut-in tool to prevent fluid flow from the production zone 14 into the tubing 36. The sleeve valve 30 controls communication between the tubing 36 and the storage zone 12. However, if the order of the production and storage zones are reversed, then the ball valve 28 controls fluid communication into the storage zone, and the sleeve valve 30 controls production from the production zone.

A circulation valve 22, which may include a sleeve valve, disk valve, or other type of valve, may also be provided in the test string 20 above the upper packer 34. The circulation valve 22 may be opened or closed to control fluid communication between the inside of the test string 20 and the annulus 19, and it may be used to spot a cushion of nitrogen gas at the end of the injection cycle. Again, the circulation valve 22 may be controlled using low-level pressure pulses or other types of mechanisms.

In one embodiment, a communications coupling device 62 is located downhole in the test string 20. The coupling device 62 may include a first portion of an inductive coupler. A device (not shown) lowered on a wireline or other electrical cable may include a second inductive coupler portion for engagement with the first inductive coupler portion in the coupling device 62. Thus, for example, the first inductive coupler portion may include a first coil and the second inductive coupler portion lowered into the wellbore may include a second coil adapted to communicate with the first coil when the coils are vertically aligned. Example inductive couplers may be those described in U.S. Pat. Nos. 4,806,928 and 4,901,069, having common assignee as the present application and hereby incorporated by reference.

The coupling device 62 is electrically coupled to the pressure and temperature sensors and recorders 66 as well as other instruments that may be part of the test string 20. The coupling device 62 provides a mechanism through which data collected and stored by downhole instruments may be communicated to surface equipment. Further, when the inductive coupler portions are aligned, commands and other control signals may be sent by surface equipment down to electronic components located in the lower test string section 21. In further embodiments, electromagnetic communication and acoustic communication may be used in the downhole environment.

In operation, the chamber 37 is filled initially with a gas (e.g., air, nitrogen, etc.). The type of fluid used depends on the pressure of the reservoir in the production zone. Alternatively, the chamber 37 may be filled with liquid. Gas in the chamber 37 may be advantageously used since the ball valve 28 may then be opened to allow fluids from the production zone 14 into the chamber 37, pushing the cushion of gas in the chamber 37 upwardly. During flow of the production fluids, pressure, temperature, and flow rate measurements may be collected by instruments downhole, including the pressure and temperature sensors 66 and flow rate detectors in the adjustable choke device 64. Also, measurements of the gas flow may also be made by surface instruments, such as the gauge 46.

After well fluids have filled the chamber 37 to a predetermined level, the ball valve 28 is closed to shut in the production zone 14. The sleeve valve 30 may be opened to allow communication between the chamber 37 and the storage zone 12. Actuation of the valves 28 and 30 may be accomplished using annulus low-level pressure signals, for example, or other activating mechanisms. At that point, it may be desirable to flush out the production fluid (including hydrocarbons) that have filled up a portion of the chamber 37 so another test can be performed. Flushing the production fluid from the chamber 37 may be accomplished by opening the valve 42 (FIG. 1) at the surface to pump liquid from the liquid source 48 into the chamber 37. The liquid (referred to as pumping fluid) may include water, a heavy-weight kill fluid, or other types of fluids. The liquid from the liquid source 48 is pumped into the chamber 37 to push production fluid in the chamber 37 through the sleeve valve 30 into the storage zone 12. Once the production fluid has been forced out of the chamber 37 into the storage zone 12, the sleeve valve 30 may be closed. At that point, the chamber 37 has filled up with pumping fluid (e.g., water, kill fluid, etc.). The pumping fluid is removed from the chamber 37 through the circulation valve 22 into the annulus 19.

To prevent blow-out of either the storage zone 12 or the production zone 14, heavy-weight kill fluid may be maintained in the annulus 19. Thus, if the pumping fluid includes a kill fluid, then the circulation valve 22 may be simply opened (using annulus low-level pressure pulses, for example) to allow the pumping fluid to be flowed into the annulus region 19 by pumping gas (with the surface pump 49) from the gas reservoir 50 into the chamber 37.

Alternatively, if the pumping fluid in the chamber 37 is lighter weight than the kill fluid in the annulus 19, the circulation valve 22 may be opened and pressure applied from above in the annulus region 19 to pump kill fluid from the annulus 19 into the lower portions of the tubing 36. This is followed by removing the pressure in the annulus region 19 and applying gas from the gas reservoir 50 at the surface into the chamber 37 to force the fluid back out into the annulus region 19 through the circulation valve 22 and hence a cushion of nitrogen gas can be spotted in the chamber 37. This ensures that the annulus 19 remains filled with kill fluid (and not a lighter fluid such as water) to prevent blow-outs up the annulus 19.

The process described above can be repeated multiple times to perform multiple flows from the production zone 14. Using the test string 20 according to some embodiments, multiple test cycles may be accomplished to improve clean-up of the formation under test so that better fluid samples may be taken. In addition, an enlarged chamber is provided to increase the volume of production fluid so that deeper testing of the formation in the production zone 14 may be accomplished. The increased volume of test production and multiple test cycles may be accomplished without having to produce any significant amount of hydrocarbons to the surface, which may present environmental risks.

Figure 3A:
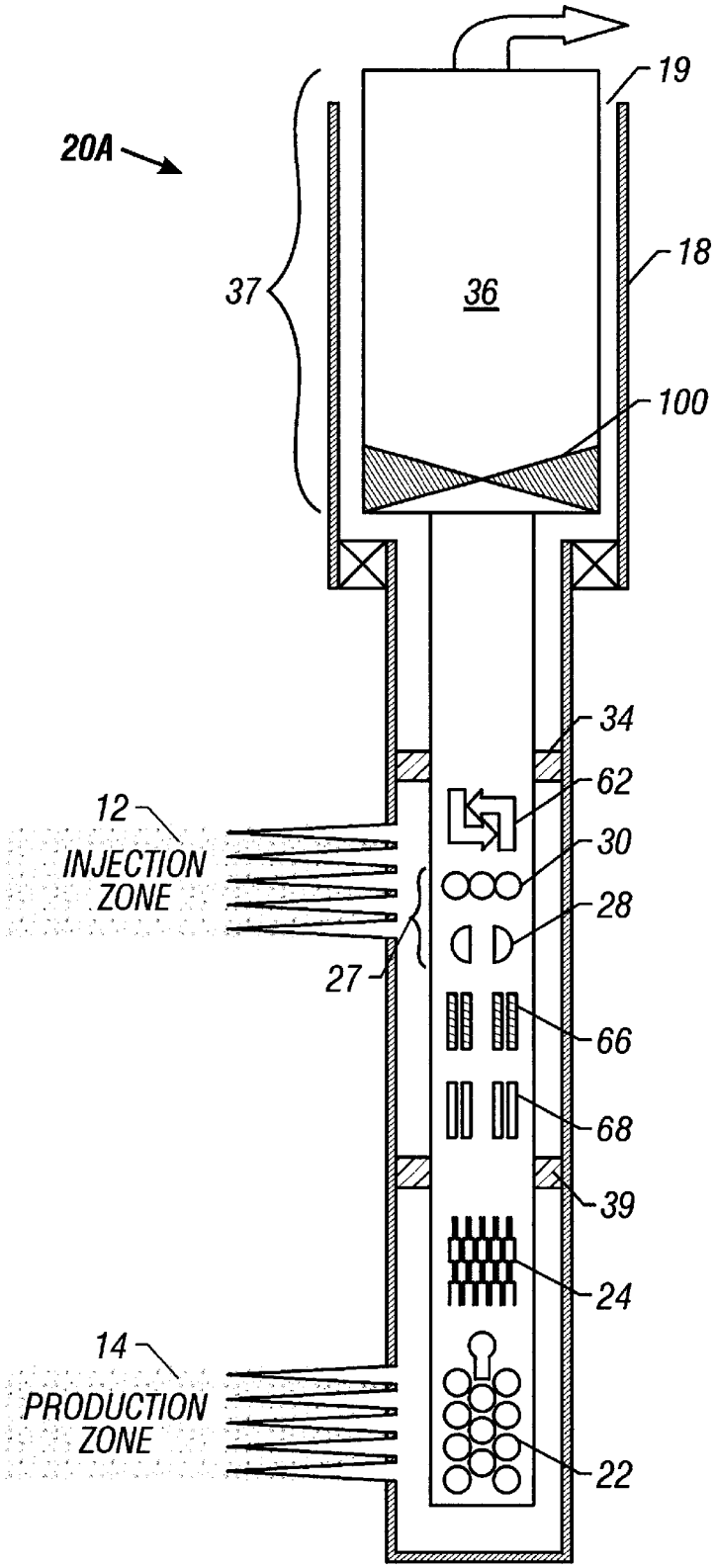
Figure 3B:
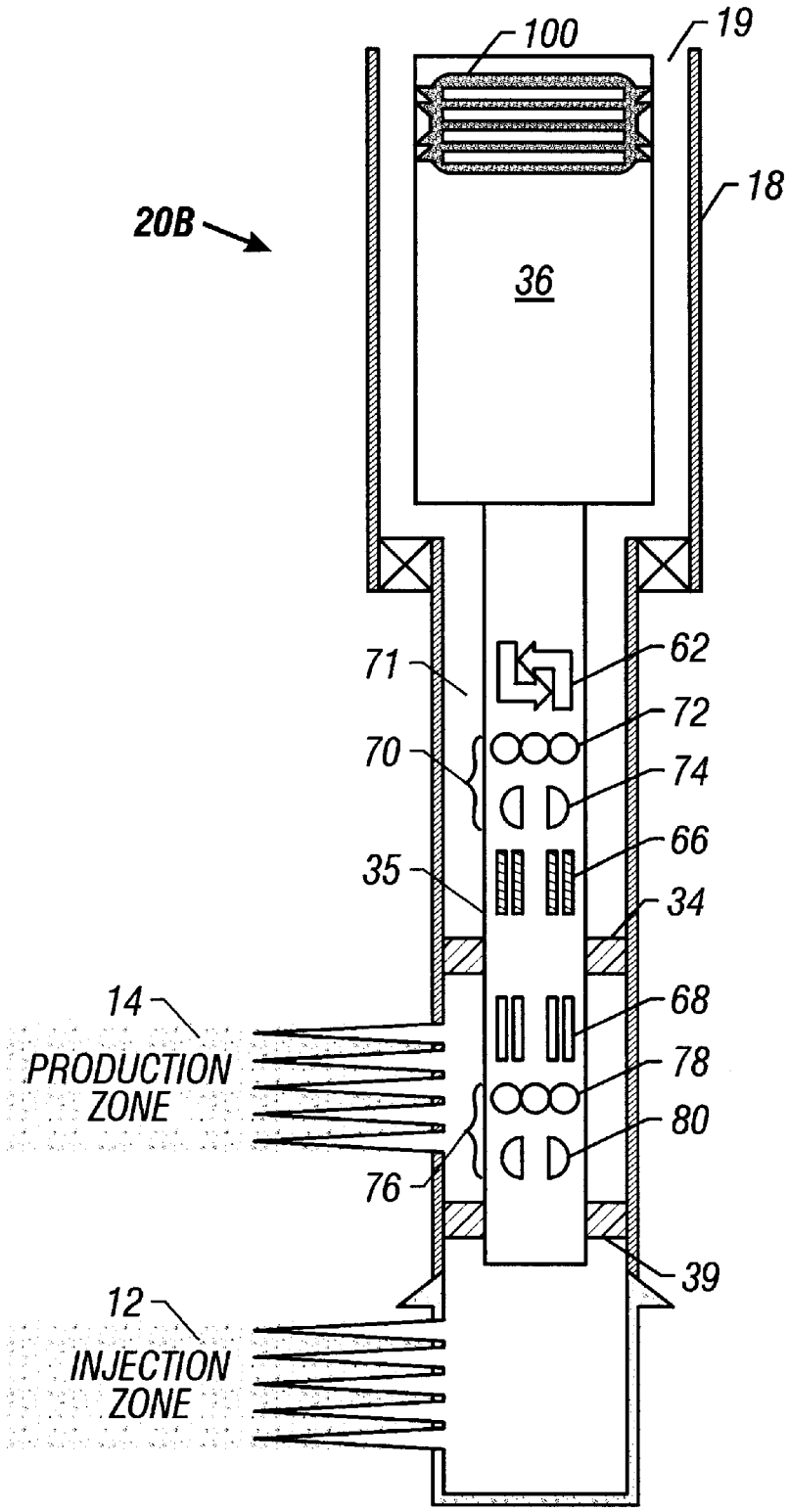
Figure 4:
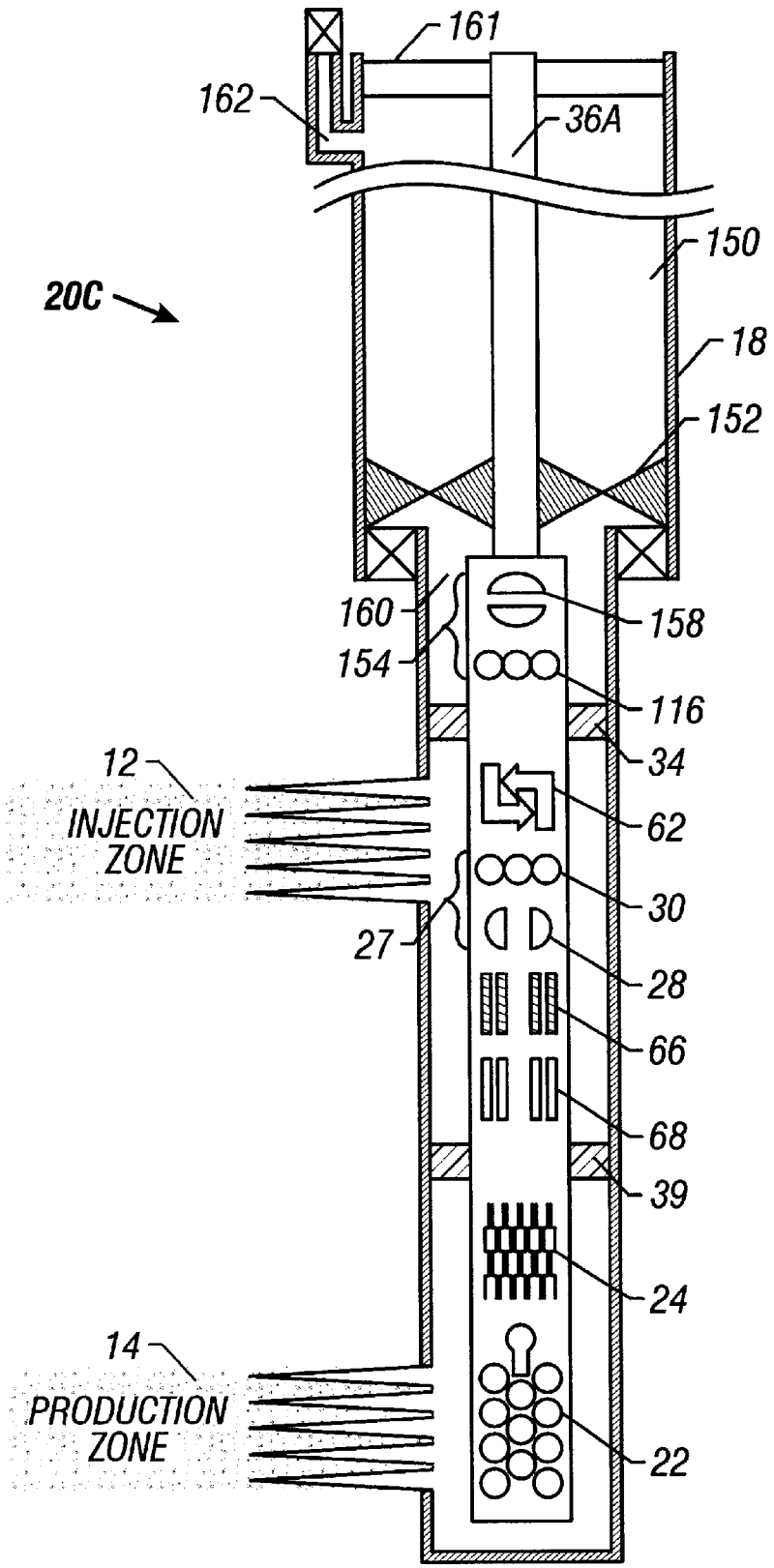

Referring to FIGS. 3A, 3B and 4, alternative embodiments of test strings are illustrated. In the FIG. 3A embodiment, a test string 20A may include many of the same components of the test string 20 in the FIG. 2 embodiment. However, the circulation valve 22 and adjustable choke device 64 may be removed from the test string 20A in the FIG. 3A embodiment. In addition, a moveable isolation device 100 may be placed in the chamber 37 to separate the chamber 37 into first and second portions. The moveable isolation device may also be referred to as a stripper device and includes sealing elements that seal against the inner wall of the tubing 36 in response to a differential pressure across the isolation device 100.

The test string 20A is adapted for use with formations in production zones that have relatively high pressure gradients which are sufficient to lift liquids that may exist in the chamber 37. The isolation device 100, which may include a plug, may be movably positioned in the tubing 36. The isolation device 100 prevents flow of hydrocarbon (especially gas) in the test string 20A past the isolation device 100 so that production of hydrocarbon gas to the surface is eliminated. The isolation device 100 is moveable upwardly by the applied pressure from production fluid entering the tubing 36.

A gas or liquid may be present in the chamber 37 above the isolation device 100. In one embodiment, the upper portion of the chamber 37 includes gas or water or other liquid that is not so heavy weight that production fluid would be unable to move the isolation device 100 upwardly. Thus, when the ball valve 28 is opened to allow flow of production fluid from the production zone 14, the production fluid moves the isolation device 100 upwardly. The liquid contained in the chamber 37 above the isolation device 100 is pushed out of the chamber 37 and into a choke manifold 53 (FIG. 1) located at the surface, which controls the flow of fluid from the chamber 37. The surface gauges 46 attached to the conduit 52 can monitor flow rate and amount of liquid flow from the chamber 37.

A downhole sensor device (in communication with or capable of sensing the position of the isolation device 100 and in electrical communication with surface equipment, for example) can provide an indication of the depth of the isolation device 100. Alternatively, the sensor device may be positioned at a desired depth in the tubing 36. The sensor device may be in electrical communication (e.g., wired or wireless) with the isolation device 100 such that the depth of the isolation device 100 can be monitored or determined. As with the test string 20, measurements may be collected downhole with the pressure and temperature sensors and recorders 66. Samples of production fluid may also be obtained by the sampler device 68.

Flow control may be monitored and controlled based on data provided by the surface gauges 46 and downhole sensor device. If it is determined that the isolation device 100 has been raised to a certain height in the chamber 37, production flow can be shut off by shutting off downhole valves and, afterwards, shutting off the choke manifold 53. The control may be performed by a controller (located at the surface or downhole) electrically coupled to the sensor device and the surface gauges 46.

After a first flow cycle, the ball valve 28 may be closed to allow fluid pumped into the chamber 37 to force the isolation device 100 back down the tubing 36. If the sleeve valve 30 is opened, the downward movement of the isolation device 100 in the presence of applied pressure from the surface forces fluid in the chamber 37 into the storage zone 12. After the chamber 37 has been emptied of the production fluid, the sleeve valve 30 may be closed and the ball valve 28 reopened to start the next production flow. This may be repeated as many times as desired.

The FIG. 3B embodiment is similar to the FIG. 3A embodiment except that the slotted pipe 24 and gun 22 are omitted in the test string 20B of FIG. 3B. In addition, the relative positions of the production and storage zones 14 and 12 are reversed. To provide the desired flow control, two sets of flow control valves 70 and 76 may be employed. In other embodiments, the flow control valve set 70 may be omitted. The lower flow control valve 76 (which includes a sleeve valve 78 and a ball valve 80) is adapted to selectively control flow from the production zone 14 and into the storage zone 12. The ball valve 80 is closed and the sleeve valve 78 opened to enable fluid flow from the production zone 14. On the other hand, the ball valve 80 is opened and the sleeve valve 78 closed to enable fluid flow into the storage zone 12.

The upper flow control valve 70 selectively controls fluid flow between the pipe 35 and an annulus region 71. The ball valve 74 is opened and the sleeve valve 72 is closed to enable fluid communication with one of the production and storage zones 14 and 12 through the lower flow control valve 76. However, the ball valve 74 is closed and sleeve valve 72 is opened to enable circulation between the inner bore of the pipe 35 and tubing 36 and the annulus regions 71 and 19.

Referring to FIG. 4, a test string 20C that is a modification of the test strings 20A and 20B of FIGS. 3A–3B are illustrated. In this embodiment, a large volume control chamber 37A is not located inside the tubing 36 (as in the FIG. 3A or 3B embodiment) but rather is located in the annulus region 150 between a reduced diameter tubing 36A and the casing 18. By using the annulus region 150 as the test chamber, further increased production volume during testing may be achieved. In addition, handling of the reduced diameter tubing 36A may be easier than the enlarged tubing 36 in the FIG. 3A or 3B embodiment.

In the FIG. 4 embodiment, the isolation device 152 is adapted to move up and down in the annulus region 150 in the presence of pressure from below or above. An upper flow control valve 154 includes a sleeve valve 156 and a ball valve 158. The ball valve 158 remains closed to prevent flow of fluid up the tubing 36A. During the test, the sleeve valve 156 may be opened to allow flow of production fluid up the test string 20C, out of the sleeve valve 156, and into an annular region 210 underneath the isolation device 152. The applied pressure from the production zone 14 is adapted to move the isolation device 152 upwardly, pushing liquid in the annulus region 150 through a conduit 162 to the surface choke manifold 53. An annular plug 161 seals the annulus 150 above the port leading into the conduit 162. After a flow cycle has completed, the ball valve 28 in the lower flow control valve 27 is closed and the sleeve valve 30 in the lower flow control valve 27 is opened. Surface pressure is then applied against the isolation device 152 to push it downwardly, forcing production fluid in the annular region 160 out of the sleeve valve 30 into the storage zone 12. The production and injection cycles can be repeated any number of times to perform testing.

Figure 5:
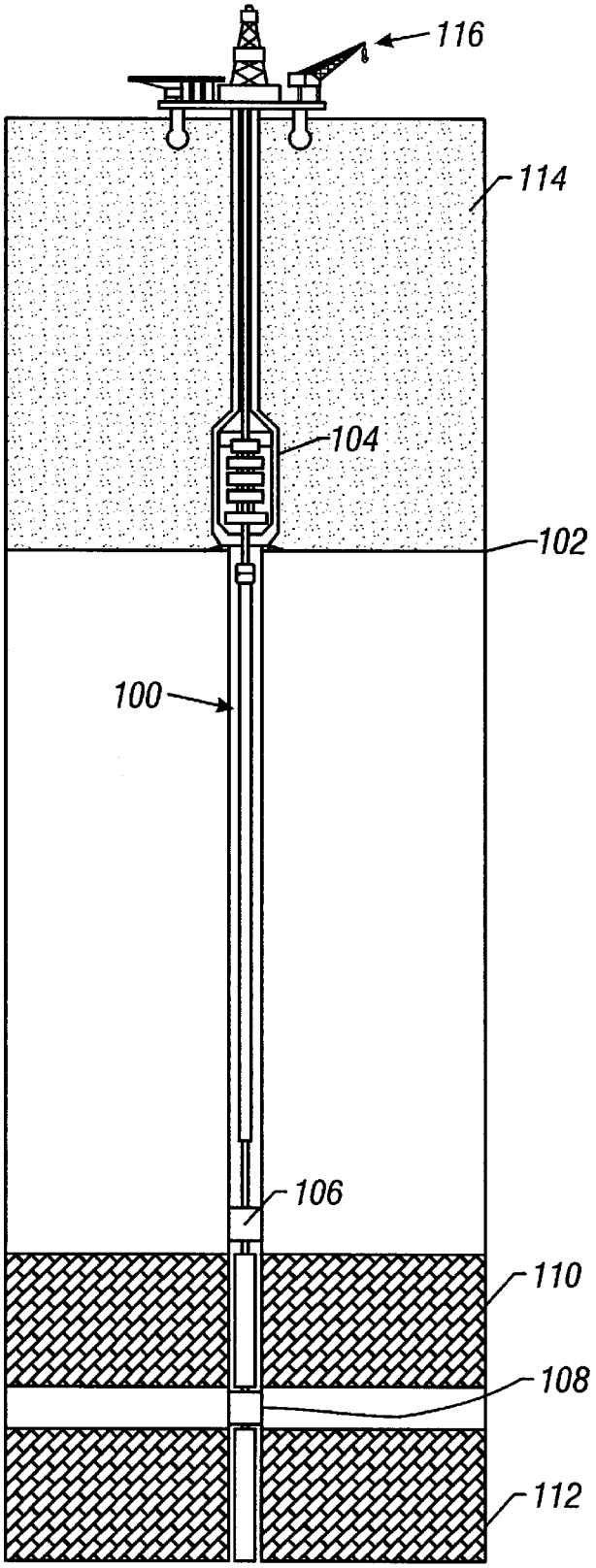
FIG. 5 illustrates an embodiment of a subsea test string.

Referring to FIG. 5, an example embodiment of a test string for use in a subsea well is illustrated. A test string 100 in accordance with this embodiment is positioned in the wellbore below the sea bottom surface (referred to as the mudline) 102. A blowout preventer (BOP) 104 is positioned above the sea bottom surface 102. The test string 100 extends through an upper packer 106 and a lower packer 108 to zones 110 and 112. One of the zones 110 and 112 may be a production zone while the other one is a storage zone. The BOP 104 is connected through a landing string 114 to a sea surface platform 116.

Figure 6A:
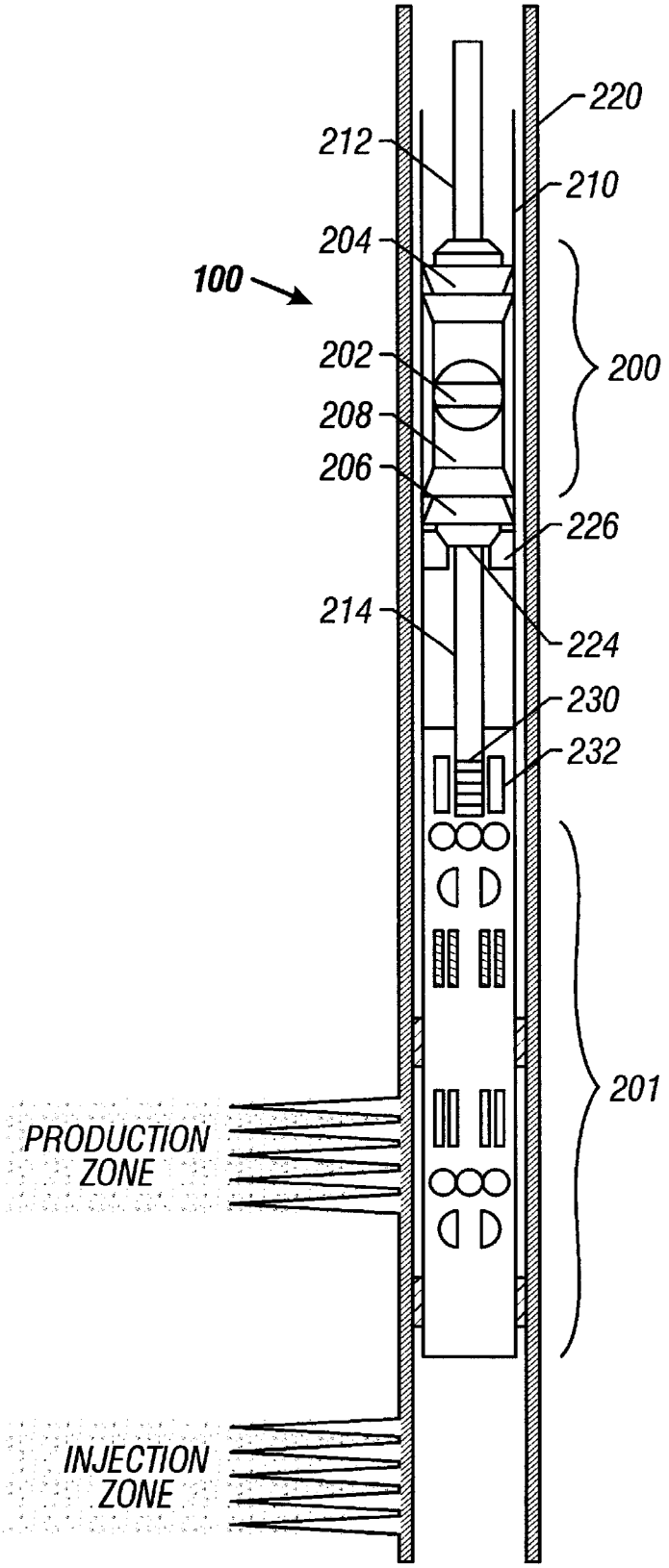
FIG. 6A illustrates a lower portion of the test string of FIG. 5 in accordance with one embodiment.

Referring to FIG. 6A, a lower portion of the test string 100 is illustrated. The test string 100 includes an isolation device 200 that includes upper and lower sealing elements (e.g., cup packers 204 and 206), which may be formed of an elastomer material. The cup packers 204 and 206 provide a seal against the inner wall of a tubing 210 in the presence of differential pressure across the device 200. The isolation device 200 further includes a midsection 208 that includes a valve 202 (e.g., a ball valve or flapper valve). In the illustrated position, the valve 202 is in its closed position to prevent fluid communication between the zones above and below the isolation device 200. The isolation device 200 is slideable in the tubing 210 that is positioned inside casing 220.

As illustrated in FIG. 6A, the tubing 210 extends to the production and storage zones in the wellbore. Thus, unlike the FIGS. 1 and 2 embodiment, an enlarged tubing is not provided in the illustrated embodiment of FIG. 6A. However, in further embodiments, an enlarged tubing may be employed if a larger flow chamber is desired.

At its upper end, the isolation device 200 is connected to an upper spacer member 212. At its lower end, the isolation device 200 is connected to a lower spacer member 214. The upper and lower spacer members 212 and 214 may also be considered part of the isolation device 200. A mating portion 224 below the lower cup packer 206 is abutted to a stop 226 that is attached to the tubing 210. The stop 226 includes face seals to provide a sealing abutment when the mating portion 224 is abutted to the stop 226.

The lower end of the spacer member 214 includes a first inductive coupler portion 230 that is capable of being inductively coupled with a second inductive coupler portion 232 that is part of the lower test string section 201. Thus, when the isolation device 200 is shown in its lowered position, the inductive coupler portions 230 and 232 are lined up to provide an electrical communications path to test equipment (e.g., sensors, control modules, gauges, and so forth) in the lower test string section 201. Effectively, the inductive coupler portions 230 and 232 form a data transfer module to enable communication of collected data.

The second inductive coupler portion 232 is electrically connected (such as by an electrical cable) to the various electrical devices that may be part of the lower test string section 201. In accordance with some embodiments, the isolation device 200 may include an electronic storage element, such as integrated circuit memory devices and the like. The isolation device 200 may also include control circuitry connected to the storage element as well as a power source (e.g., a battery) to provide electrical power to the storage element and control circuitry. When the isolation device 200 is in its lowered position, and the inductive coupler portions 230 and 232 are aligned, then the storage element is capable of receiving measurement data collected by sensors or gauges in the lowered test string section 201. In addition, the control circuitry in the isolation device 200 may also be capable of sending command signals to flow control devices in the lower test string section 201 to open, close, or set the flow control devices at intermediate positions. The control circuitry in the isolation device 200 may also be capable of controlling other types of devices (e.g., reprogram pressure gauges and flow meters) in the lower test string section 201.

In alternative embodiments, instead of using a data transfer module including inductive coupler portions, the data transfer module may include electromagnetic signal transceivers, acoustic telemetry transceivers, or mechanical contacts.

Figure 6B:
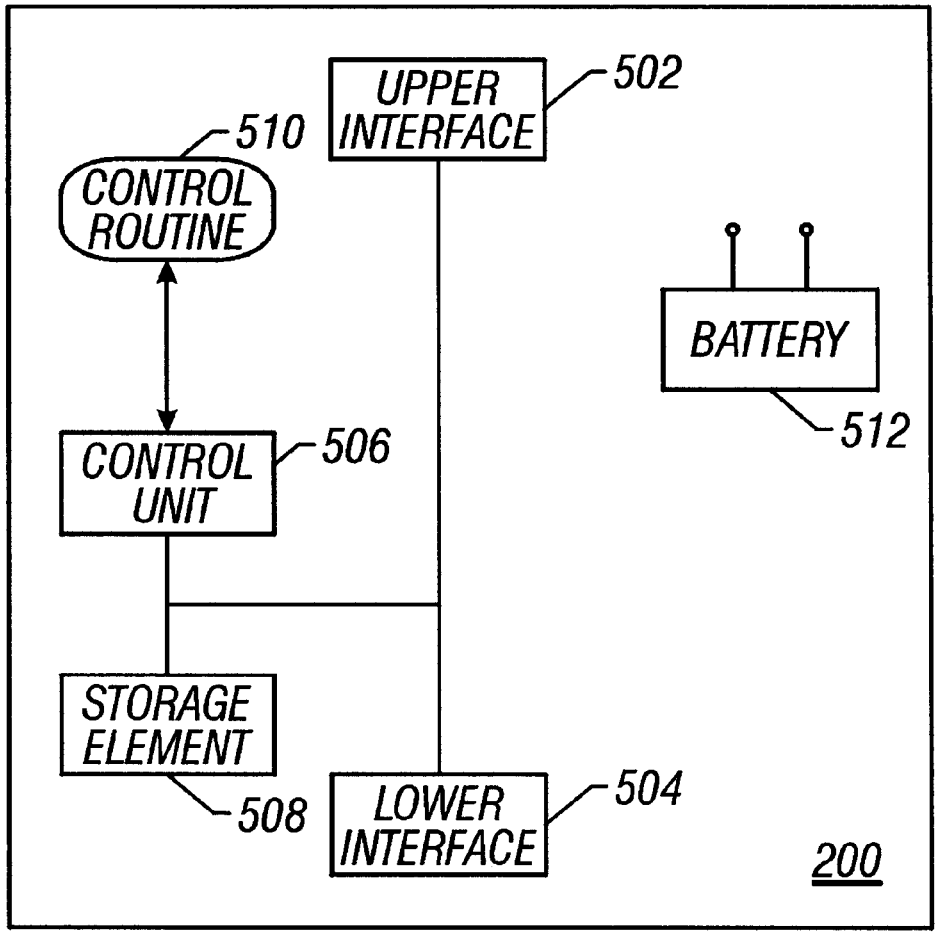
FIG. 6B is a block diagram of components in an isolation device in accordance with an embodiment in the test string of FIG. 5.
Figure 8:
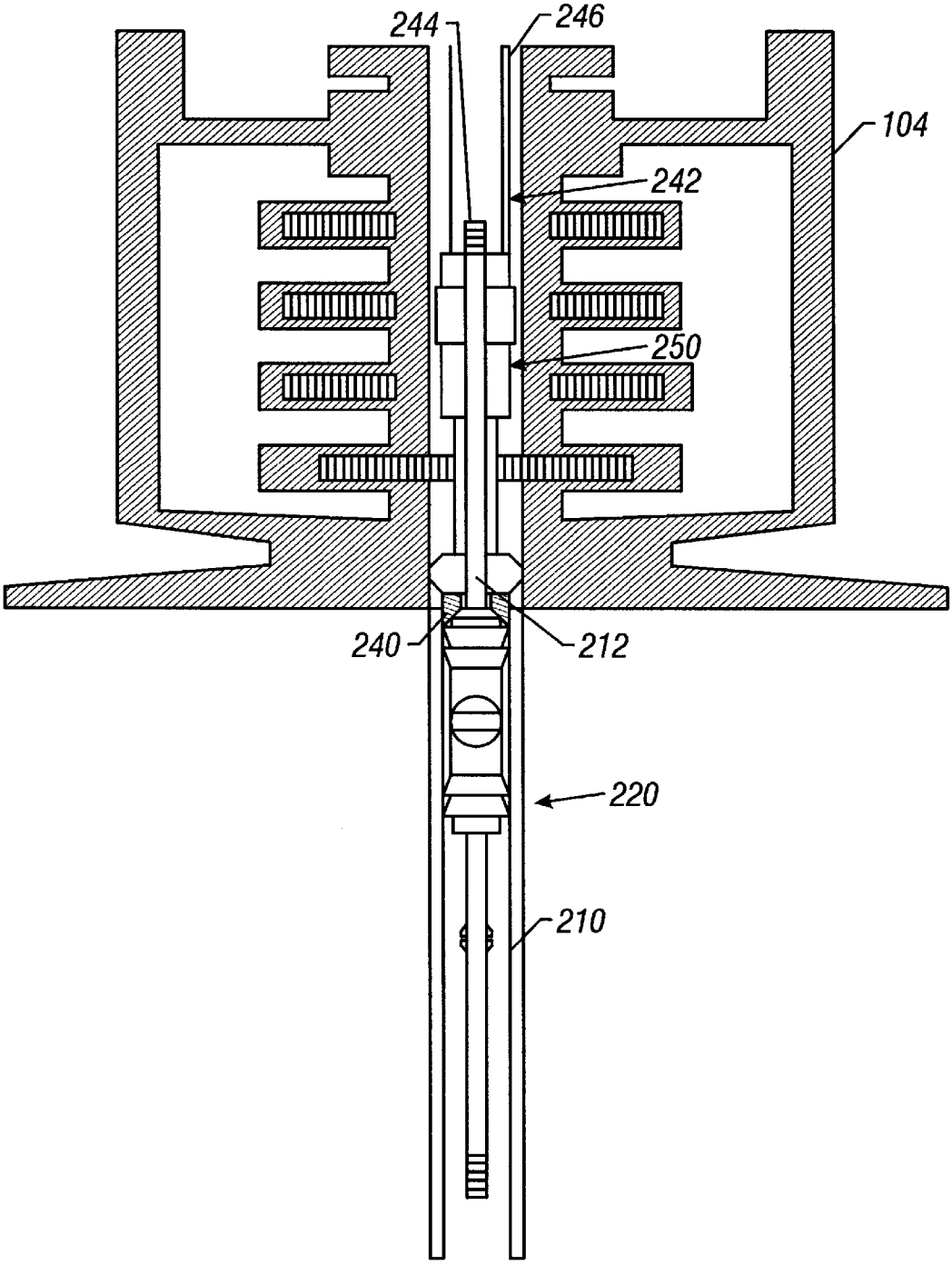
FIG. 8 illustrates an upper portion of the test string of FIG. 5 in accordance with one embodiment.
Figure 9:
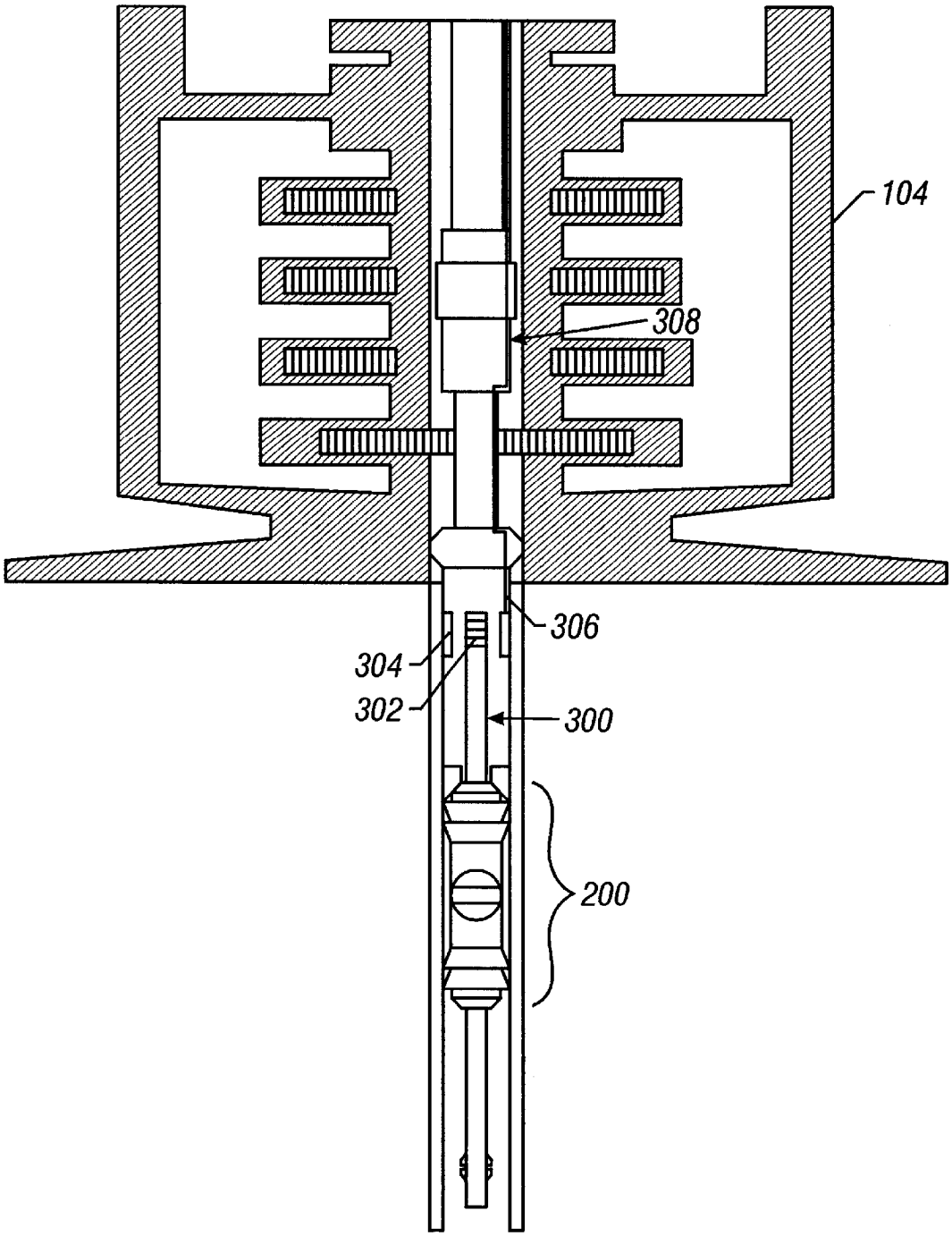
FIG. 9 illustrates an upper portion of the test string of FIG. 5 in accordance with another embodiment.

Referring to FIG. 6B, the components of the isolation device 200 are illustrated. The isolation device 202 may include upper and lower interface circuits 502 and 504. The lower interface circuit 504 is adapted to communicate signals with a lower data transfer module, such as the inductive coupler portion 230. The upper interface circuit 502 is adapted to communicate signals with an upper data transfer module, such as an inductive coupler portion 244 or 302 (FIG. 8 or 9).

A control unit 506 provides control of tasks performed by the isolation device 200, including receiving collected data from downhole sensing instruments, providing commands to downhole devices, and transmitting data stored in a storage element 508 through the upper interface circuit 502 to the upper data transfer module. The control unit 506 may be run under control of one or more control routines 510, which may be in the form of firmware or software. A battery 512 provides the power source in the isolation device 200.

Figure 7A:
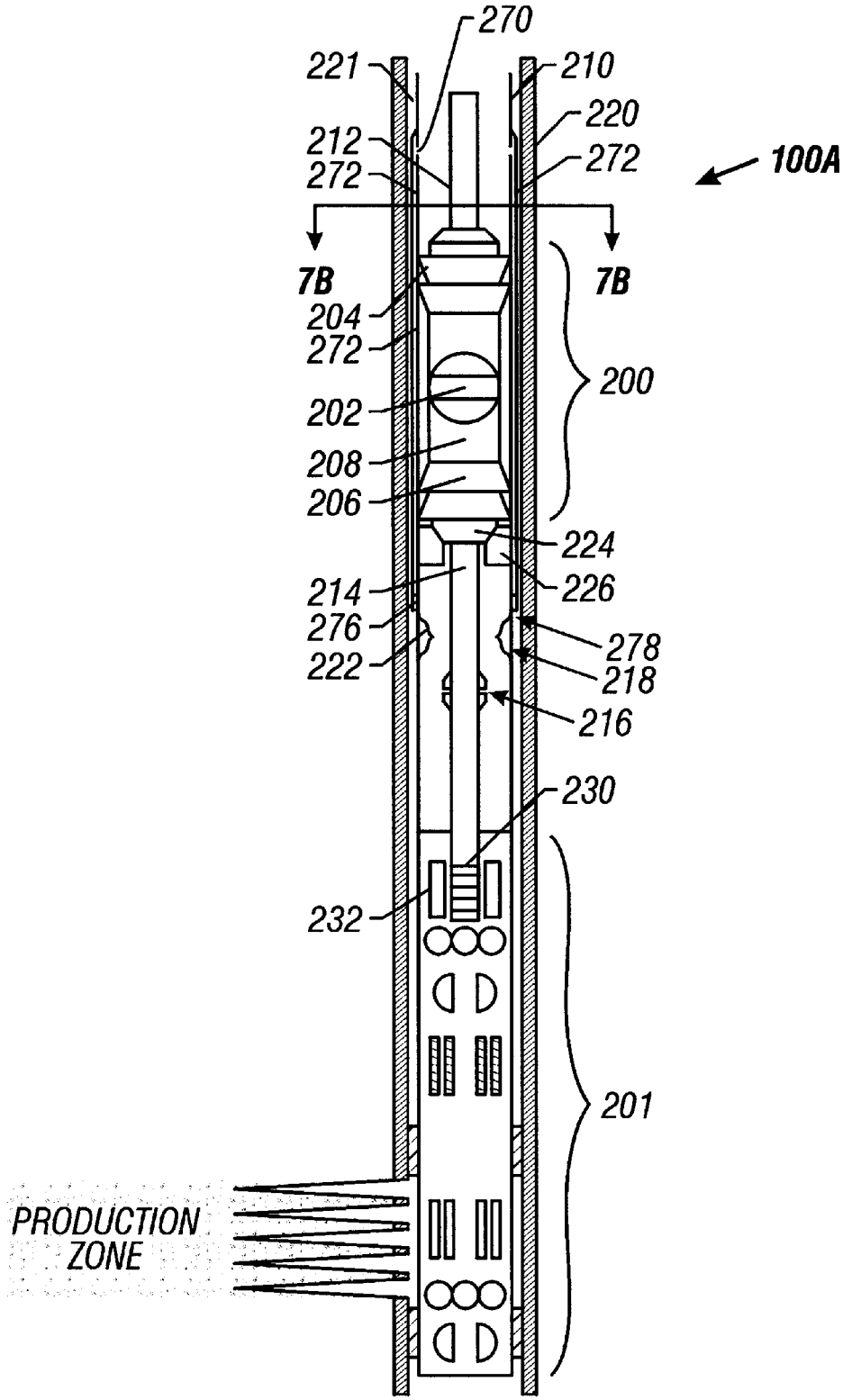
FIG. 7A illustrates a lower portion of the test string of FIG. 5 in accordance with another embodiment.
Figure 7B:
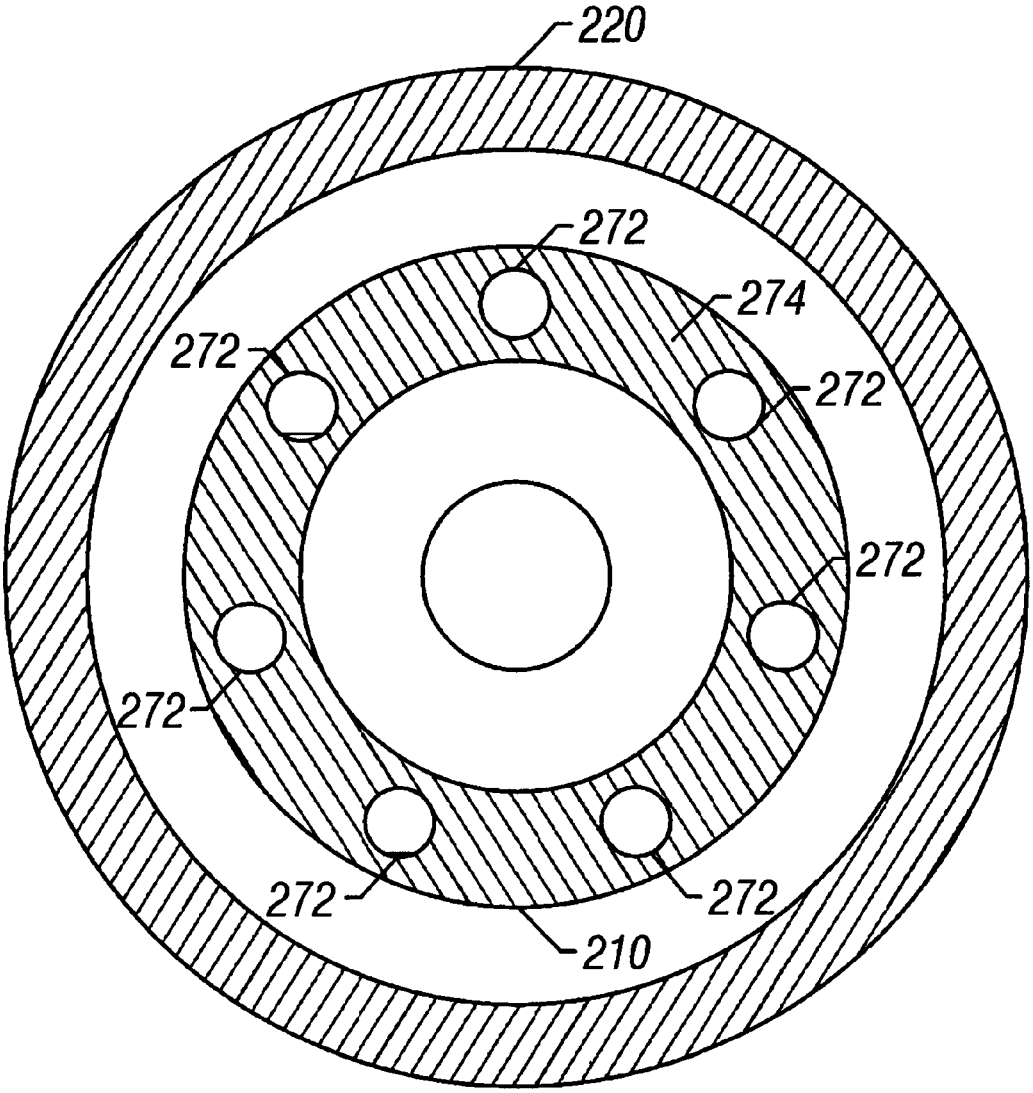
FIG. 7B is a cross-sectional view of the test string portion of FIG. 7A.

Referring to FIG. 7A, a variation of the test string, referred to as 100A, is illustrated. The test string 100A includes the same elements as the test string 100 but in addition includes a circulation port 270 that provides communication between the inner bore of the tubing 210 and plural longitudinal conduits 272 (as shown in FIG. 7B). The conduits 272 are formed in the housing 274 of the tubing 210. The longitudinal conduits 272 have a length to enable communication between the inner bore of the tubing 210 above the isolation device 200 (in the lowered position) and the tubing-casing annulus 221. Check valves 276 are positioned at the lower ends of the longitudinal conduits 272 to enable fluid flow from the tubing 210 inner bore to the annulus 221 but not from the annulus 221 to the tubing 210 inner bore. Outlet ports 278 at the bottom ends of the longitudinal conduits 272 lead into the annulus 221.

A flow control device 218 (or plural flow control devices) is adapted to control flow through the outlet ports 278. In the position illustrated, the flow control device 218 is in the open position. The flow control device 218 (which may include a sleeve, for example) has an operator with a profile 222 adapted to be engaged by an operator 216 (e.g., a shifting or setting tool) attached to the lower spacer member 214. The outlet ports 278 when opened enable circulation between the inner bore of the tubing 210 and the tubing-casing annulus 221. The profile 222 of the operator of the flow control device 218 is engaged by the shifting or setting tool 216 as the lower spacer member 214 is raised or lowered in the tubing 210.

By employing the arrangement shown in FIG. 7A for fluid communication between the tubing 210 bore above the isolation device 100 and the annulus 221 below the isolation device 100, the inner diameter of the tubing 210 inner bore is not reduced by the presence of a flow control device (or other mechanism associated with the flow control device) that may prevent lowering of the isolation device 200 past the mechanism.

Referring to FIG. 8, the isolation device 200 is shown in its raised position (near the well surface). Pressure in the tubing 210 pushes the isolation device 200 against a stop 240. The upper end of the upper spacer member 212 has an inductive coupler portion 244 that is capable of communicating with a surface inductive coupler portion 242 that is part of the BOP 104. In a subsea well, the surface inductive coupler portion 242 is connected to an electrical cable 246, which is part of the umbilical control line for the subsea test tree 308. The umbilical cable 246 can extend up through the landing string 114 (FIG. 5) to the surface platform 116. In the FIG. 8 embodiment, the upper spacer member 212 extends through a subsea test tree 250 inside the BOP 104.

Referring to FIG. 9, in accordance with another embodiment, a shortened upper spacer member 300 (as compared to the upper spacer member 212 in FIG. 8) is shown. In this embodiment, the upper end of the spacer member 300 is also attached to a first inductive coupler portion 302. However, a second inductive coupler portion 304 is connected to the tubing 210 below the BOP 104. Thus, when the isolation device 200 is in its upper position, the inductive coupler portions 302 and 304 are lined up below BOP 104. An electrical cable 306 extends from the second inductive coupler portion 304 through the subsea test tree 308 of the BOP 104. Alternatively, an electromagnetic communications link or acoustic communications link may be employed instead of the electrical cable 346.

Figure 10:
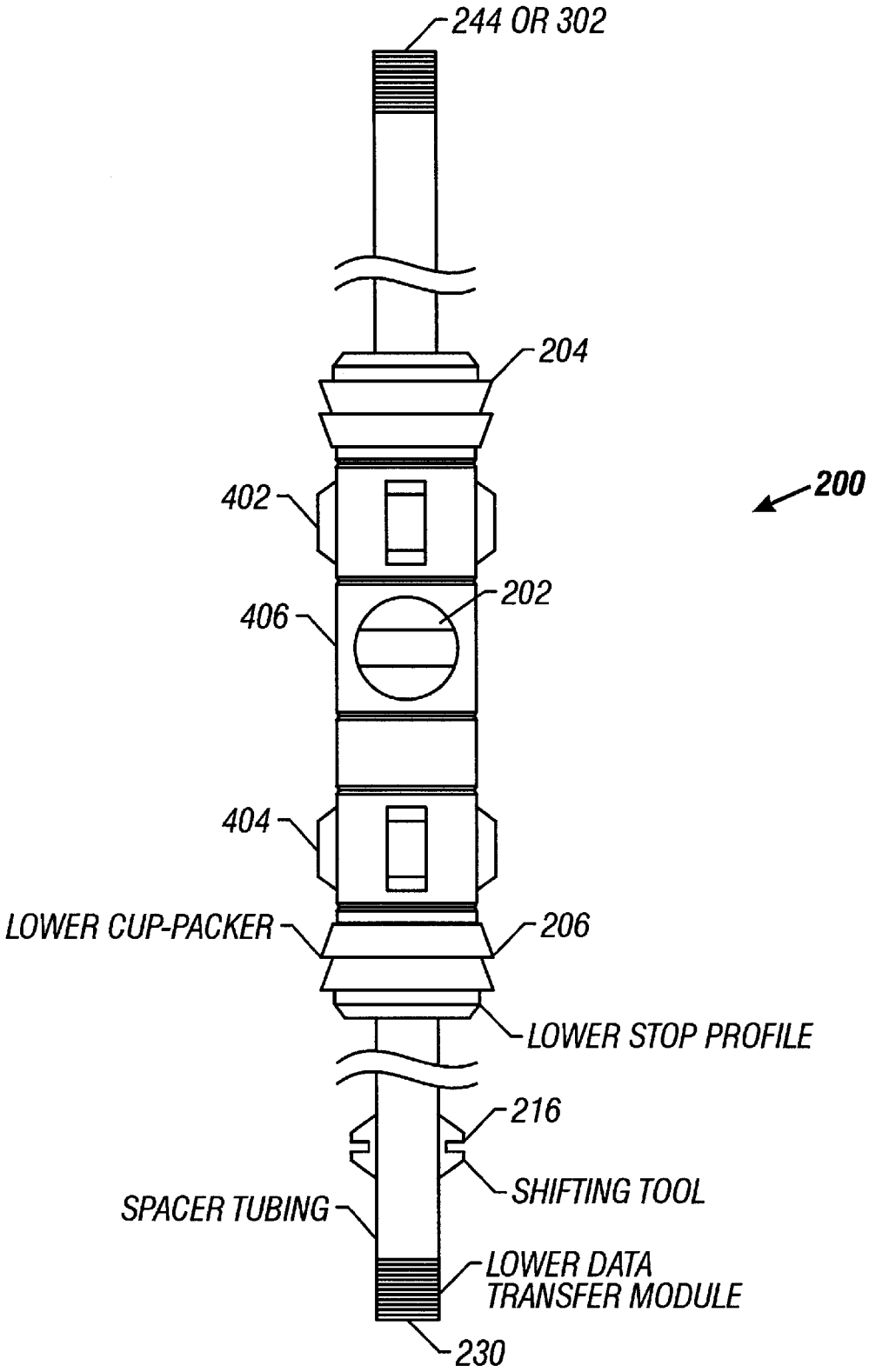
FIG. 10 illustrates a moveable isolation device in the test string of FIG. 5 in accordance with an embodiment.

Referring to FIG. 10, the isolation device 200 is shown in greater detail. To reduce stress on the cup packers 204 and 206, centralizers 402 and 404 are attached to the outer housing of the midsection 406 of the isolation device 200. The midsection 406 of the device 200 may include the ball valve 202.

In test operation, valves in the lower test string portion 201 (FIG. 6A) are set at the appropriate positions to produce fluid from the production followed by injection of the produced fluids collected in the closed chamber into the injection or storage zone. During the production phase, sensors and gauges in the lower test string portion 201 may be activated to collect desired measurements. After the production phase is completed, the injection phase is started in which the isolation device 200 is moved downwardly by application of an elevated pressure above the isolation device 200. Once the isolation device 200 has moved down to its lowered position at the end of the injection phase, the inductive coupler portion 230 attached to the lower spacer member 214 is aligned with the inductive coupler portion 232.

At that point, the collected measurement data can be transferred from the downhole sensors through the inductive coupler portions 230 and 232 to the storage elements in the isolation device 200. At the end of the injection phase, gas or a light-weight liquid may again be spotted above the isolation device 200 to allow a subsequent production phase to move the isolation device 200 upwardly. Circulation valves may be opened to allow the heavier fluid above the isolation device to circulate into the annulus 221. With the FIG. 7A embodiment, the operator 216 attached to the lower spacer member 214 automatically opens the circulation valve 218 as the isolation device 200 is lowered and the operator 216 engages the profile 222 of the circulation port 226.

During the next production phase, the isolation device 200 is moved upwardly to its top position, where the inductive coupler portion 244 (FIG. 8) or 302 (FIG. 9) is aligned with a corresponding inductive coupler portion 242 (FIG. 8) or 304 (FIG. 9). At that point, data stored in the storage elements in the isolation device 200 may be transferred to the surface equipment.

The production and injection cycles can be repeated many times. After completion of the test cycles, the ball valve 202 in the isolation device may be opened (by pressure pulse telemetry, a hydraulic mechanism, or other activating mechanism) to allow communication through the isolation device 200. A heavy-weight fluid may then be applied down the tubing 210 and communicated to the production zone to kill the production zone. At relevant points during the test cycle, the valve 202 may also be opened to enable insertion of a wireline tool through the isolation device 200 and into the chamber 37 or test string section 21.

In another embodiment of isolation device 100/200 (not shown), pressure gauges and perhaps other sensors or meters are installed on the lower end of isolation device 100/200. Such gauges/sensors/meters can provide readings of the fluid therebelow.

In a further embodiment, isolation device 100/200 may be slidably disposed directly on casing 18 (instead of in chamber 37). Of course, the isolation device 100/200 of this embodiment would have to be appropriately sized to seal and slide on casing 18.

While fluid is within chamber 37, chamber 37 may also be used as a gravity separator to separate oil from water. In this embodiment, a sufficient amount of time must pass (without injecting the fluid into the injection zone) to allow such separation. The oil-water contact and percentages may then be measured with the appropriate instruments. The separated water may also be disposed of prior to injecting the oil into the injection zone.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A method of testing a well having a first zone and a second zone, comprising:

flowing fluid from the first zone into a first portion of a chamber; and moving an isolation device that divides the chamber into the first chamber portion and a second chamber portion in a first direction in response to the fluid flow into the first portion; and applying an elevated pressure in the second chamber portion to move the isolation device in a second direction to flow the fluid in the first chamber portion into the second zone.

2. A method of testing a well having a first zone and a second zone, comprising:

flowing fluid from the first zone through a flow conduit and into a chamber;

keeping the fluid within the chamber for a set period of time; and removing the fluid from the chamber to the second zone after the expiration of the set period of time; and performing the flowing, keeping, and removing steps a plurality of times.

3. The method of claim 2, further comprising monitoring characteristics of the fluid while the fluid is within the chamber.

4. A method of testing a well having a first zone and a second zone, comprising:

providing a test string including a chamber, a flow conduit, a first valve, and a second valve;

opening the first valve to enable fluid flow from the first zone through the flow conduit and into the chamber;

after an amount of fluid has flowed into the chamber, closing the first valve to isolate the first zone; and opening the second valve to enable fluid flow from the chamber into the second zone.

5. The method of claim 4, wherein opening and closing the first valve comprises opening and closing a valve selected from the group consisting of a ball valve, a flapper valve, and a sleeve valve.

6. The method of claim 5, wherein opening the second valve comprises opening a valve selected from the group consisting of a ball valve, a flapper valve, and a sleeve valve.

7. The method of claim 4, wherein the well extends from a surface, the method further comprising:

pumping fluid from the well surface into the chamber to flush fluid into the second zone.

8. The method of claim 4, further comprising:

filling an annulus region outside the chamber with kill fluid to prevent blow-out of the first and second zones.

9. The method of claim 4, further comprising:

controlling an adjustable choke device to control flow rate from the first zone to the chamber.

10. The method of claim 9, wherein controlling the adjustable choke device to control the flow rate comprises maintaining a substantially constant flow rate.

11. A method of testing a well having a first zone, comprising:

flowing fluid from the first zone through an adjustable choke into a chamber; and maintaining the fluid flow rate into the chamber at a substantially constant rate by use of the adjustable choke.

12. The method of claim 11, further comprising:

opening a valve to flow the fluid from the chamber into a second zone.

13. The method of claim 12, further comprising:

using at least one sensor to detect a characteristic of the fluid.

14. A method for testing a well having a first zone and a second zone, comprising:

providing a chamber having an isolation device;

flowing fluid from the first zone into the chamber; and removing fluid from the chamber to the second zone by use of a pump located exterior to the tool string.

15. The method of claim 14, wherein providing the chamber comprises providing a conduit extending substantially to a well surface.

16. The method of claim 14, further comprising:

moving the isolation device in the chamber as fluid is flowed into the chamber and removed from the chamber.

17. A test system for testing a well having a first zone and a second zone, comprising:

a chamber;

an isolation device in the chamber;

a tool string having a production inlet, an injection outlet, and the chamber;

the production inlet providing communication for fluid from the first zone to the chamber;

the injection outlet providing communication for fluid from the chamber to the second zone; and a pump located exterior to the tool string for inducing the injection of fluid from the chamber into the second zone.

18. The test system of claim 17, wherein the chamber comprises a conduit extending substantially to a well surface.

19. The test system of claim 17, wherein the isolation device is adapted to move in the chamber as fluid is communicated into and out of the chamber.

20. A method or testing a well having a first zone and a second zone, comprising:

opening a ball valve to allow flow of fluid from the first zone into a chamber;

closing the ball valve;

performing a build-up test of the first zone against the ball valve; and injecting the fluid from the chamber into the second zone.

* * * * *